United States Patent [19]

Bögner et al.

[11] 4,243,964

[45] Jan. 6, 1981

[54] ELECTROMAGNETICALLY OPERATED SWITCH, PARTICULARLY STARTER SWITCH FOR AUTOMOTIVE STARTER MOTORS

[75] Inventors: Karl-Heinz Bögner, Neuhausen; Martin Sprenger, Vaihingen, both of Fed. Rep. of Germany

[73] Assignee: Robert Bosch GmbH, Stuttgart, Fed. Rep. of Germany

[21] Appl. No.: 10,051

[22] Filed: Feb. 7, 1979

[30] Foreign Application Priority Data

Mar. 30, 1978 [DE] Fed. Rep. of Germany ..... 2813699

[51] Int. Cl.[3] ..... H01H 7/16; H01H 75/00

[52] U.S. Cl. ..... 335/156; 200/DIG. 42; 335/175; 335/192

[58] Field of Search ..... 335/156, 175, 192, 194; 200/DIG. 42

[56] References Cited

U.S. PATENT DOCUMENTS

| | | | |
|---|---|---|---|
| 1,291,039 | 1/1919 | Lowenstein et al. | 335/175 |
| 2,238,154 | 4/1941 | Borgkvist | 335/194 X |
| 2,540,185 | 2/1951 | Brown | 335/156 |
| 3,130,284 | 4/1964 | Woods | 335/156 |
| 3,848,206 | 11/1974 | Prouty et al. | 335/194 X |
| 4,158,828 | 6/1979 | Kindelspire | 335/156 |

FOREIGN PATENT DOCUMENTS

| | | |
|---|---|---|
| 646670 | 11/1950 | United Kingdom . |
| 749284 | 5/1965 | United Kingdom . |
| 793811 | 4/1958 | United Kingdom . |
| 925132 | 5/1963 | United Kingdom . |
| 999856 | 7/1965 | United Kingdom . |
| 1202713 | 8/1970 | United Kingdom . |
| 1266335 | 3/1972 | United Kingdom . |

*Primary Examiner*—Fred L. Braun

*Attorney, Agent, or Firm*—Frishauf, Holtz, Goodman & Woodward

[57] ABSTRACT

In order to effectively disconnect a contact bridge from fixed terminals, even though the contact bridge may be sticking to the contacts, or may be welded or hang, a plunger-type armature core is slidable within a central sleeve of a solenoid for a travel path which is in excess of the connecting path length of the contact bridge towards the fixed terminals. Upon disconnection, a spring returns the armature plunger and, with it, a switching rod which will pass through the overtravel path length before engaging the contact terminals, if the contact terminals should stick, thus exerting a blow against the connecting bridge and tearing it away from the contact terminals.

13 Claims, 4 Drawing Figures

ELECTROMAGNETICALLY OPERATED SWITCH, PARTICULARLY STARTER SWITCH FOR AUTOMOTIVE STARTER MOTORS

The present invention relates to an electromagnetically operated switch, and more particularly to a starter relay for a starter motor to start automotive-type internal combustion engines.

BACKGROUND AND PRIOR ART

Starter motors to start automotive internal combustion (IC) engines require a heavy current for a short period of time. To connect this current to the motor, relays are used which must carry the heavy starting current required by the starter motor. Normally, the starter motor is operated only for very short periods of time so that, with respect to an equivalent continuous duty motor, the electrical components of the starter motor are under-designed to save costs; similarly, the contact elements of the starter relay, which do not carry current for a long time, should be designed, for economy reasons, for intermittent operation. Due to the difficult environmental operating conditions of automotive engines, and their starters, the relay must meet severe design requirements with respect to resistance to shock, vibration, and the like; they must be essentially sealed to prevent contamination by dampness, road salt, and the like; and they must be extremely reliable since many motor vehicles cannot be started unless the starter relay is operative. Conversely, as soon as energization current for the starter relay is disconnected, the circuit should be broken to prevent damage to the starter motor.

A starter relay of the type to which the present invention relates includes a housing which has a solenoid winding therein, in electromagnetic cooperation with a plunger-type armature core which can move axially with respect to the solenoid. The core is guided by a guide sleeve and carries a contact bridge element which, when the relay is energized, effects a cross connection between two contact terminals extending into a switching chamber, in which the contact bridge is operative. Springs are provided to reset the contact carrier bridge, or the core, or both, respectively, and maintain the contact bridge out of engagement with the fixed terminal contacts, unless the solenoid is energized.

In such an arrangement, a contact pressure spring can be provided to engage the longitudinally movable core and the contact carrying bridge to provide for reliable connection of the terminal contacts. It has been found that, if the contact bridge should stick to the fixed contact terminals, if the contact terminals should weld, or for other reasons the relay should "hang", it is very difficult to separate the contact bridge from one, or both, of the terminals so as to not only reliably connect, but also reliably interrupt starter motor current to the starter motor of the IC engine.

THE INVENTION

It is an object to improve the construction of electromagnetically operated switches, and especially starter relays, to provide for reliable connection as well as for reliable interruption of current flow; additionally, the starter relay should be inexpensive to make and of small size.

Briefly, the contact bridge is carried on an operating rod connected to the movable core of the relay; springs are provided to ensure positive engagement of the contact bridge with the fixed terminals facing the contact bridge upon axial movement of the core when the solenoid is energized. Upon deenergization of the coil, a spring pushes the contact away. The operating rod of the core, upon energization, has a travel path which is longer, however, than the connecting travel of the contact bridge; if then the contact bridge should stick on the terminals, since it may have been slightly welded thereto or otherwise does not separate under the ordinary spring pressure, the over-running of the operating rod, attached to the mass of the core, will, in its return path to normal disconnected position then engage the sticking contact plate and tear it off. Essentially, the arrangement provides for a lost motion in the disconnect operation, that is, an over-travel of the operating rod, so that, upon disconnection, the operating rod will engage the terminal bridge while it is already moving so that the combined inertia of the moving operating rod and the core can provide a disconnect or tear-off force to reliably disconnect the current through the bridge and between the terminals of the relay.

In a preferred construction, the operation rod or bolt is secured at one end with the core of the relay and is formed with a switching shoulder or abutment intermediate its length. A sleeve is arranged around the operating rod and movable therewith to resiliently press the contact plate against fixed terminals in the relay structure, when the relay is energized. The relative travel between the sleeve and the contact bolt permits travel of the bolt beyond the engagement position of the bridge with the fixed terminals and thus provides the over-travel which, upon disconnection, causes engagement of the moving bolt with the bridge in disconnecting direction.

The structure has the advantage that the contact bridge, unless released by spring pressure, is rapidly torn off its connection with the fixed contacts since the disconnecting movement will occur after the core and the operating rod have already moved in the direction of its rest or quiescent position.

In accordance with features of the invention, the construction can be so made that the vibration resistance of the overall arrangement is improved, which is important in the rough operating conditions of automotive vehicles. The overall length of the relay can be decreased with respect to previously used relays, which is important since, with decrease in size and motor vehicles, the space availability for accessory equipment is at a premium. Further, the relay can be made inexpensively and with cost-saving material arrangements and a lesser number of components than prior art relays of this type.

Drawings, illustrating preferred examples:

Figure 1:
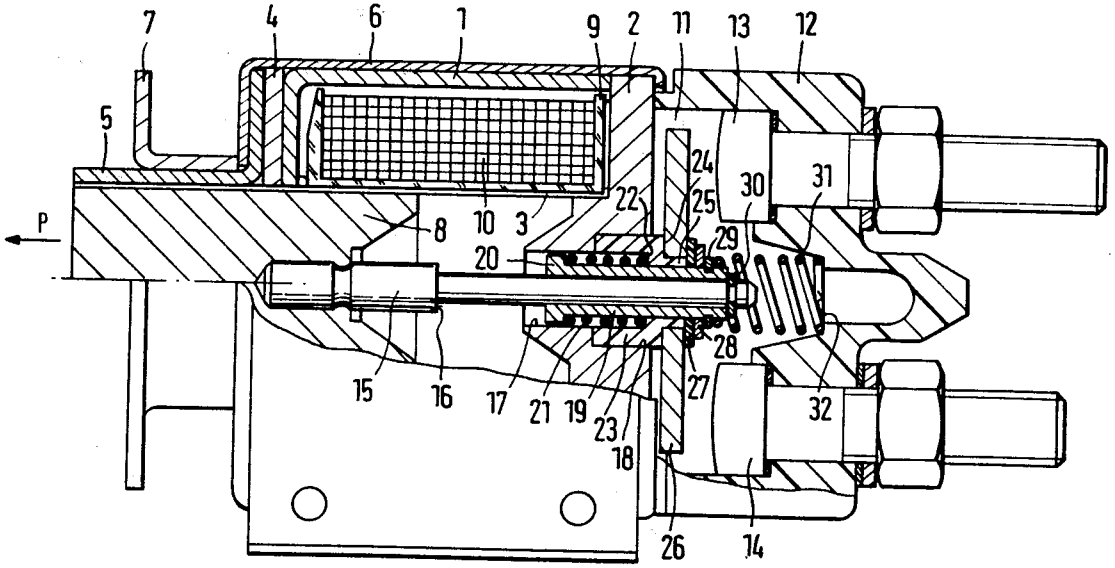
FIG. 1 is a part-sectional, part-side view, with the outer wall broken away in portions, in longitudinal illustration, and showing a first embodiment.

The electromagnetic switch has a cup-shaped return yoke 1, and a magnetic core 2; a brass sleeve 3 is held within the core 1. A magnetic return disk 4 is located at the other end face of yoke 1; the remote side of disk 4 has a non-magnetic, for example brass, sleeve 5, with an upturned flange located thereagainst. Sleeve 5 acts as a guide sleeve plunger armature for core 8 which is movable longitudinally within the brass sleeve 3 and sleeve 5. Various other constructions of guiding the core 8 for longitudinal movement can be used. The entire assembly is held together by a housing 6, which is rolled or peened over the end flanges of the structure formed by the end disk 2 of the yoke and the flange of the sleeve 5. The sleeve 5 additionally carries a bearing ring 7 for a reset spring which tends to move the core 8 in the direction of the arrow P; arrow P symbolizes a reset force exerted by such a reset spring (not shown, and standard in electromagnetic switching units). The core 8 is guided in the sleeves 3, 5, and principally in the sleeve 3, to move longitudinally, centrally therein, essentially non-binding and immune to vibration. Any suitable structure of a reset spring attached to the core and acting in the direction of arrow P can be used. The spring (not shown) tends to hold the core 8 in the position shown in FIG. 1, which is the quiescent or rest position. A solenoid coil 10 is located on a coil form 9. The coil 10 may have two winding portions which can be selectively energized, one winding portion being used only for holding the relay in connected position and both winding portions being used to effect connection of the relay to provide for rapid connecting movement.

The right end face of the core 2 forms one end wall of a switching chamber 11. A cap 12, preferably of insulating material, covers the chamber 11. The cap 12 is secured by suitable means to the switch housing, as is well known and not shown specifically, for example by engagement with the housing shell 6. Two main contact terminals 13, 14 are secured within the cap 12; the terminals 13, 14 extend outwardly of the cap 12 and are connected to suitable connection bolts.

A switching rod or bolt 15 is secured in the core 8. The switching rod 15 is formed with an abutment 16. The switching bolt 15 extends through a longitudinal bore 17 of the end portion 2 of the magnetic core and extends into the switching chamber 11. The longitudinal bore 17 has a substantially greater diameter than the diameter of the switching bore 15. The bore, additionally, is enlarged, as seen at the portion 18 at the side facing the switching chamber 11. A sleeve 19 of non-magnetic material, for example brass, is movably located about bolt 15. The sleeve 19 is guided, in part, in bore 17. The end portion of the sleeve 19 guided in bore 17 is formed with a small extension to form an abutment 20 for an end of the engagement contact pressure spring 21. Contact pressure spring 21 is supported on the sleeve 19 and, at the end remote from the abutment 20, engages a shoulder 22 of a contact bridge carrier 23 made of insulating plastic. The contact bridge carrier 23 is movable on the sleeve 19. Its outer surface is guided in the enlarged portion 18 of the bore 17 in the core portion 2. The end of the contact bridge carrier 23 which extends into the switching chamber 11 is formed with an engagement flange 24 and a bearing extension 25. The contact bridge 26 is placed on the extension 25 and engages the flange 24. An insulating disk 27 is placed at the other side of contact bridge 26 and located on the sleeve 19. The insulating disk 26 engages a washer 28 likewise movable with respect to the sleeve 19. Contact engagement spring 21 presses against the bridge carrier 23 and, as shown in FIG. 1, the disk 28 is thereby pressed against a holding ring 29 secured on the sleeve 19. Ring 29 may, for example, be a C-ring. Longitudinal movement of the sleeve 19 with respect to the switching rod 15 is limited by an abutment ring 30 secured to the switching rod; abutment ring 30, for example, is a C-ring. A return or "break" spring 31 engages the end of the sleeve 19 by engagement with the C-ring 29. The other end of the return spring 31 is placed in a recess 32 formed in the inside of the cap 12.

The contact bridge 26 is of contact metal and, when moved to the right, connects the inner terminals 13, 14.

The abutment 16 need not be formed on the bolt 15 itself as shown; abutment 16 may also be formed by a washer or C-ring snapped over the bolt 15, thus permitting use of a bolt of smaller diameter, which is less costly and requires less machining.

Operation: FIG. 1 (as also FIGS. 2 and 3) illustrates the magnetic switch in rest or de-energized position. Upon energization of winding 10, core 8 is moved towards the right, that is, within the solenoid 10 and into the brass sleeve 3 counter the force of the reset spring, that is, counter force P. Upon such movement to the right, the relative position of sleeve 19 and of bolt 15 will change until the abutment 16—or an equivalent C-ring or the like—engages the sleeve 19. This is a first, inwardly directed lost motion. Upon further movement of the core 8 to the right (FIG. 1), the abutment or disk 16 will press sleeve 19 and hence the contact engagement spring 21 and with it the contact bridge carrier 23 and the contact bridge 26 towards the right, so that the bridge 26 will connect the terminals 13, 14. The force of the opening or breaking spring 31 as well as the force of the reset spring P must be overcome by the electromagnetic force of winding 10. When the armature or core 8 is in engagement with the core element 2, that is, when the connecting movement is terminated, both the engagement spring 21 as well as the break or return spring 31 are stressed, that is, are compressed. Upon connection of terminals 13, 14, an electrical circuit, for example to the starter motor of the vehicle connected between terminals 13 and 14 is completed through bridge 26. The starter motor is now energized and, upon engagement of the starter gear, the IC engine can be started, as well known.

The current requirements of the starter motor, particularly upon first moving the IC engine from stopped to moving condition is high. As soon as the IC engine is started, the current supply to the switch is normally disconnected. The core 8 is thus moved by the force P of the reset spring (not shown) towards the left. At the same time, the return spring 31 acts on the ring 29 and sleeve 19 to press the bridge 26 back into the released and open position shown in FIG. 1. The contact bridge carrier or support will enter the enlarged portion 18 of the bore 17 of core 2 and will engage the right-side abutment thereof.

The foregoing is the normal operation which occurs under ordinary operating conditions. It may occur, however, that due to unusual operating conditions, contact bridge 26 will stick to either one or both of the contact terminals 13, 14, causing a relay hang-up; under extreme conditions, a welding action between the contact bridge 26 and one or both of the terminals 13, 14 may result at localized points, and the force of the return spring 31 may not be sufficient to release bridge 26 from the terminals 13, 14. The ring 30 of the rod 15 continues to move to the left (FIG. 1), however, under force P of the reset spring (not shown). When the bolt or rod 15 has moved to the left within the sleeve 19, the ring 30 thereof will, in the course of its movement, engage the sleeve 19 and, by transmission of force through the sleeve 19, ring 29, washer 28 and disk 27 tear the bridge 26 away from the contacts 13, 14. The core 8, rod 15, bridge 26 and the other movable elements 19, 21, 23, 31 then will reach their quiescent or rest position, thus disconnecting current to the motor, which will stop.

The rod 15, coupled to the core 8, thus will engage—through the various washers and disks—the contact plate 26 while it is moving, and the inertia force of the moving combined mass of the core 8 and rod 15, suddenly engaging the plate 26 will, in effect, result in a tear-away force in form of a blow in contact-opening, current-interrupting direction to reliably and rapidly tear away the contact bridge 26, even though it may be sticking on the contact terminals 13, 14, or may have been slightly welded thereto, and holding with a force which cannot be overcome by the continuously and gradually applied force of the contact return spring 31.

In the other embodiments, similar parts previously described will not be described again, and similar parts, which operate similarly, have been given the same reference numerals.

Figure 3:
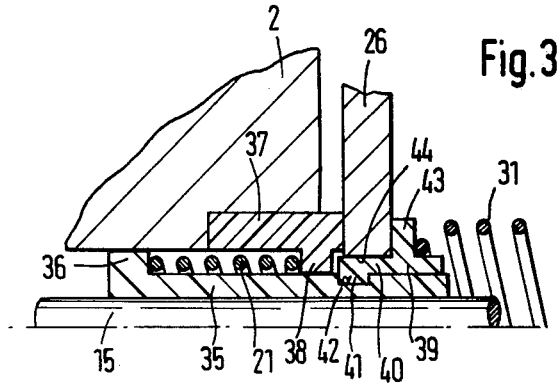
FIG. 3 is a fragmentary half-section view of yet another embodiment.
Figure 2:
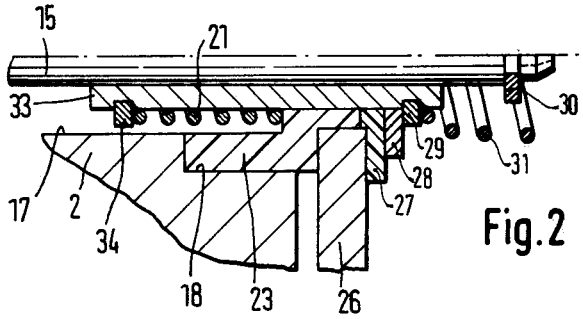
FIG. 2 is a fragmentary half-sectional view illustrating another embodiment of a holding arrangement for the contact bridge.

Embodiment of FIG. 2: Sleeve 35 is located on switching rod 15. An engagement ring 34 for the connection spring 21 is located on sleeve 33 formed, for example, as a C-ring. The spring 21 engages the contact bridge carrier 23 which is movable on the sleeve 33 and guided in the portion 18 of the bore 17 of the core portion 2. Contact bridge 26 is located as described in connection with FIG. 1. Sleeve 33 can be manufactured as a straight sleeve requiring only two grooves to fit the C-rings 29, 34 therein, and is economical to make, requiring little machining, while being economical in material use. FIG. 3 illustrates the position of rod 15 intermediate its travel towards the right, that is, before the abutment or ring 16 has engaged sleeve 33, but after initial energization of the coil 10, that is, upon initial movement of the core 8 and hence of rod 15 towards the right (FIG. 1 or 2). The operation, in all aspects, is the same as that explained in connection with FIG. 1.

Embodiment of FIG. 3: A sleeve 35 of insulating material, for example plastic, is movable on the bolt 15. Sleeve 35 is formed with an axial enlargement or abutment 36 facing the left side, that is, core 8, on which spring 21 is engaged, as in the embodiment of FIG. 1. The contact bridge carrier 37 is also of insulating plastic. It is formed with an interior shoulder 38 to provide a counter-abutment for the other end of spring 21. The bridge carrier 37 is guided in the enlargement 18 of the bore 17 of the core portion 2. A bushing element 39 is secured to the other end of the sleeve 35. The bushing element 39 has a radially resilient portion 40 formed with inwardly directed engagement projections 41, snapped in and engaging in a circular groove 42 formed in the sleeve 35. Bridge 26 is seated on the bushing 39, specifically on the sleeve-like portion 40 thereof. One end face of the bridge 26 engages the end face of the carrier 37. The other end face engages flange 43 formed on the bushing 39. The return or "open" spring 31 is secured to the end portion of the bushing 39. Spring 31 is supported in the cap 12 as illustrated in FIG. 1.

The carrier bushing 39 can be made as a unitary element and formed with a slotted portion 40 in order to form the projections 41 to be resilient so that, upon assembly, the bushing 39 can be slipped over the sleeve 35 until the projections 41 engage in groove 42, by snapping inwardly. The bushing 39 can also be made in essentially two half-portions, connected together, so that only one connecting web in the flange 43 holds the two portions together, tending to essentially surround the sleeve 35. Spring 31 will then maintain the essentially two halves of the bushing 39 together. The bushing 39 can also be completely subdivided, formed essentially in two shells, the portion 40 of which is slipped through the circular space between the sleeve 35 and the bore 44 in the bridge 26 until the projections 41 engage in the groove 42; the two half-portions again are held together by the opening 44 in the bridge 46 and, at the other end, by the spring 31.

In operation, the arrangement of FIG. 3 operates identically to that of FIG. 1. The rod 15 extends beyond the break-away end as shown in FIG. 3 and is formed, as in FIGS. 1 and 2, with an end holding ring 30 which, upon leftward movement of the rod 15, tears bridge 26 away from a possible sticking connection to the contact terminals 13, 14.

Figure 4:
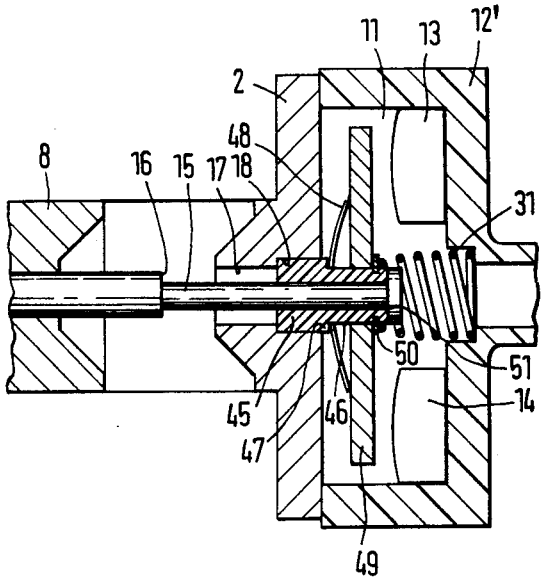
FIG. 4 is a fragmentary end view showing another arrangement of a relay structure with a disk spring.

Embodiment of FIG. 4: The core 8 is connected to rod 15, formed with an abutment 16. Core portion 2 has a longitudinal bore 17 with an enlarged opening 18 therein. The switching chamber 11 is closed off by cap 12'. The main current carrying contact terminals 13, 14 are located in the switching chamber 11. A sleeve-shaped contact bridge carrier 45 made of insulating plastic is movably positioned on the switching rod 15. The outer circumference of the plastic sleeve carrier 45 is guided in the enlarged portion 18 of the core portion 2. The contact bridge carrier 45 has a portion 46 of lesser diameter extending into the switching chamber 11. The portion 46 is formed with a shoulder 47 against which a contact pressure spring 48 can bear. Spring 48 is a leaf spring, preferably a circular leaf spring, which is engaged with its inner edge on the shoulder 47 and which bears with its outer edge against contact bridge 49. Contact bridge 49 is movable on the portion 46 of carrier 45. An engagement ring 50—e.g. a-c ring—is located close to the terminal end of the portion 46 of the contact bridge carrier sleeve 45. One side face forms an engagement side for the contact bridge 49; the other side face forms a bearing surface for the end of the return spring 31 which thereby is seated and engages the end of the contact bridge carrier sleeve 45. The switching rod 15 has an end ring 51 extending into the switching chamber 11. In the disengaged or rest position, the end ring 51 engages the end face of the portion 46 of the contact bridge carrier 45.

Operation: If armature or core 8 moves towards the right (FIG. 4) under force of the magnetic coil (not shown in FIG. 4), the switching rod 15 will at first move relative to the contact bridge carrier 45 until abutment 16 engages the carrier 45. Upon further movement towards the right of the armature 8, abutment 16 carries along the carrier 45 and presses the contact bridge 49 against the contact terminals 13, 14, the contact terminals being resiliently engaged due to the presence of the leaf spring 48. The release spring 31 is stressed in compression. When the armature 8 is pulled against the core 2, the contact release spring 31, the contact engagement spring 48, and the core return spring acting in the direction of the force P (not shown) are all stressed.

If current through the solenoid 10 is then interrupted, core 8, as described above, is returned by the core return spring, that is, under the force P, into the rest position. The contact release spring 31 engages the ring 50 and, over ring 50, tends to press the contact carrier 49 away from the terminal contacts 13, 14, to interrupt current supply to the motor.

Upon sticking, localized welding, or other adhesion of the contact bridge 49 to the main contact terminals 13, 14, the core 8, upon its return movement towards the left, carries the rod 15 along; in due course, and during this leftward movement, the ring 51 at the end of the rod 15 will engage, via the ring 50, the contact bridge carrier 45; the contact bridge 49 is then carried along by engagement with the ring 50, and subjected to the sudden blow of the moving core 8 and with it the rod 15 and the ring 51, to tear away the contact bridge 49 and permit it to move in the rest position—as shown in FIG. 4—thus again interrupting current supply between the terminals 13, 14.

As can be seen from the arrangement in FIG. 4, the portion of the rod 15 to the right of the abutment 16 is substantially longer than the length of the sleeve 45 and the path of travel of the contact carrier 49 from rest or OFF position to the engaged or ON position, thus permitting lost motion upon movement of rod 15 to the right and, upon return, engagement of the moving rod 15, carried by the core 8 to impart a separating blow on the contact bridge, if the bridge should have become stuck on the terminals 13, 14, or one of them, and is not being returned under the force of the contact release spring 31.

The core 2 is preferably formed with an inwardly, conically extending projection which fits into a similar conical recess of the core 8 to minimize the requirement for holding current through the solenoid 10 and provide for close magnetic coupling while, simultaneously, positioning the core 8 with respect to the core portion 2 in centered alignment.

Various changes and modifications may be made, and features described in connection with any one of the embodiments may be used with any of the others, within the scope of the inventive concept.

We claim:

1. Electromagnetically operated switch having a housing (6, 12) defining a switching chamber (11) therein;

a solenoid coil (10) located within the portion of the housing and having a central opening;

a core (1, 2) located against an end face of the coil and at least in part across said opening;

an armature element (8) longitudinally movable in the opening of the coil against a return force (P);

at least one fixed switch terminal (13, 14) located in the housing and extending into the switching chamber;

a movable contact carrier (26, 49) located in the housing;

a contact release spring (31) engaging the contact carrier and tending to push the contact carrier away from, and out of engagement with, the at least one switch terminal;

and connecting means coupling the armature element and the contact carrier together, comprising a switching rod (15) connected to the armature element and movable therewith;

contact engagement force transmission means (16; 19, 33, 35, 45) engageable with both the switching rod (15) and the contact carrier (26, 49) and transmitting movement of the armature, and hence of the switching rod upon energization of the solenoid to move the contact carrier in the direction of the fixed switching terminal to effect closing of the switch, said armature and switching rod being movable over a path length in excess of the length of the path of the contact carrier upon engagement thereof with the fixed terminal, thereby providing over-travel of the armature and the switching rod;

and contact release force transmission means (27, 28, 29, 30; 50, 51) secured to the switching rod (15) and engageable with the contact carrier upon deenergization of the solenoid and return movement of the armature (8) under the return force (P) after the switching rod and hence the armature have travelled over said excess path length to tear the contact carrier from the fixed switch terminal (13, 14) in case of sticking of the contact carrier thereto and failure of the contact release spring (31) to push the contact carrier away from the fixed switch terminal.

2. Switch according to claim 1, wherein the contact engagement force transmission means includes spring means (21, 48) coupling the switching rod (15) and the contact carrier (26, 49) to provide for resilient engagement of the contact carrier with the at least one fixed switching terminal (13, 14).

3. Switch according to claim 2, wherein the contact engagement force transmission means further includes a sleeve (19, 33, 35, 45) slidable within said opening of the solenoid and with respect to said switching rod (15), the sleeve being engageable by said switching rod upon travel thereof upon energization of the solenoid and hence attraction of the armature element and transmitting movement to said spring means (21, 48) and consequent engagement of the contact carrier (26, 49) with said at least one fixed switch terminal (13, 14) and permitting continued compression of said spring means during over-travel of said armature element and hence said switching rod (15) over said excess path length.

4. Electromagnetically operated switch having a housing (6, 12) defining a switching chamber (11) therein;

a solenoid coil (10) located within the portion of the housing and having a central opening;

a core (1, 2) located against an end face of the coil and at least in part across said opening;

an armature element (8) longitudinally movable in the opening of the coil against a return force (P);

at least one fixed switch terminal (13, 14) located in the housing and extending into the switching chamber;

a movable contact carrier (26, 49) located in the housing;

a contact release spring (31) engaging the contact carrier and tending to push the contact carrier away from, and out of engagement with, the at least one switch terminal (13, 14);

a switching rod (15) connected to the armature element and movable therewith;

and comprising, in accordance with the invention, a switching engagement means (16) located on the switching rod;

a sleeve (19, 33, 35, 45) surrounding said rod at one end thereof and movable within the core;

a contact spring (21, 48);

the contact carrier (26, 49) being in engagement with one end of said sleeve, and supported by one end of said spring, the other end of said spring being in engagement with, and supported by, the other end of said sleeve, and wherein the switching engagement means (16) on said switching rod (15) is spaced from said other end of the sleeve when the solenoid is deenergized and the armature is at a rest position as determined by said return force, whereby travel of the armature, and hence of the switching rod, will be longer than the travel path of the contact carrier to contact said at least one fixed switch terminal and provide for over-travel of said switching rod upon energization of the solenoid and, upon deenergization, dynamic engagement of the switching rod and the contact carrier in case of sticking of the contact carrier and failure of the contact release spring (31) to push the contact carrier away from the at least one fixed switch terminal.

5. Switch according to claim 4, wherein the contact carrier is formed as a contact bridge element (26, 49) bridging two fixed switch terminals upon closing of the switch.

6. Switch according to claim 5, wherein (FIG. 4) the sleeve is formed with an abutment (47), the spring means (49) being engageable with said abutment with one end and, with the other, being in engagement with said contact bridge.

7. Switch according to claim 6, wherein the spring comprises a leaf spring or spring disk.

8. Switch according to claim 5, wherein the sleeve is formed with an abutment (20, 34, 36, 47), the spring means, with one end, being in engagement with said abutment, said abutment being positioned at one side of said contact bridge;

and an end engagement element (29, 43, 50) secured to the sleeve and located at the other side of the bridge.

9. Switch according to claim 8, further comprising a rod head element (30, 51) positioned at the end of the rod (15) remote from said armature element (8) and engageable with the end of the sleeve adjacent said end engagement element (29, 43, 50).

10. Switch according to claim 9, further including (FIGS. 1, 2, 3) a contact bridge carrier bushing (23) slidably located on said sleeve (19, 33, 35), the contact bridge carrier bushing (23) supporting one end of said contact spring means (21) at one side thereof and forming an engagement surface (24) at the other side thereof.

11. Switch according to claim 10, wherein (FIG. 1) the contact carrier bridge (26) is a disk or strip-like element having a central opening, the contact bridge carrier bushing (21) forming a bearing bushing for the central opening of the contact carrier bridge.

12. Switch according to claim 10, wherein (FIG. 3) the contact carrier bridge is strip or disk-like and formed with a central opening;

the contact bridge carrier bushing having an end surface bearing against one side of said contact bridge carrier;

and a sleeve-like bushing element (43) fitted in the opening of the contact bridge carrier (26) and having a projecting flange (43) bearing against the other side of the contact bridge carrier (26), the sleeve-like bushing element extending through the opening formed in the contact bridge carrier (26) and having means (42) engageable with the sleeve (35).

13. Switch according to claim 12, wherein the sleeve-like bushing element (39) is at least in part radially resilient and the engagement means (42) formed thereon for engagement with the sleeve (35) comprises inwardly directed projections (41), the sleeve (35) being formed with a matching groove (42) for engagement by said projections and permitting snap-in of the projections into the groove.

* * * * *